United States Patent [19]

Axelsson et al.

[11] 4,286,413

[45] Sep. 1, 1981

[54] HOLE GRINDING MACHINE

[75] Inventors: Holger Axelsson, Bromma; Lars Siggelin, Tumba, both of Sweden

[73] Assignee: Aktiebolaget Bofors, Bofors, Sweden

[21] Appl. No.: 112,385

[22] Filed: Jan. 16, 1980

[51] Int. Cl.[3] ..... B24B 7/10

[52] U.S. Cl. ..... 51/3; 51/108 R

[58] Field of Search ..... 51/3, 5 D, 108 R, 215 CP, 51/237 T

[56] References Cited

U.S. PATENT DOCUMENTS

| | | | |
|---|---|---|---|
| 3,430,388 | 3/1969 | Gabrielli | 51/5 D |
| 3,488,886 | 1/1970 | Braum | 51/3 |
| 3,924,355 | 12/1975 | Tatsumi | 51/3 |
| 4,052,821 | 10/1977 | McCandless | 51/108 R |

*Primary Examiner*—Harold D. Whitehead
*Attorney, Agent, or Firm*—Pollock, Vande Sande & Priddy

[57] ABSTRACT

A hole grinding machine is provided which includes a frame, two displaceable grinding spindles arranged on the frame, and two chucks facing the grinding spindles for holding and moving workpieces to be machined. The chucks are fastened to rotatable chuck spindles supported by an indexing head which is rotatably supported by a shaft arranged on the frame. The shafts of the chuck spindles are arranged in the same plane and at the same distance from but on either side of the shaft of the indexing head. Between a given pair of machining operations the indexing head is rotated one-half turn so that the chucks change places in front of the grinding spindles. The indexing head is then rotated one-half turn in the opposite direction between the next pair of machining operations, so that the head reciprocates between two end positions. These positions are defined by two fixed stops in the frame and a stopping cleat on the indexing head, the cleat being moved alternatingly into contact with one and then the other of the stops.

10 Claims, 10 Drawing Figures

FIG. 8
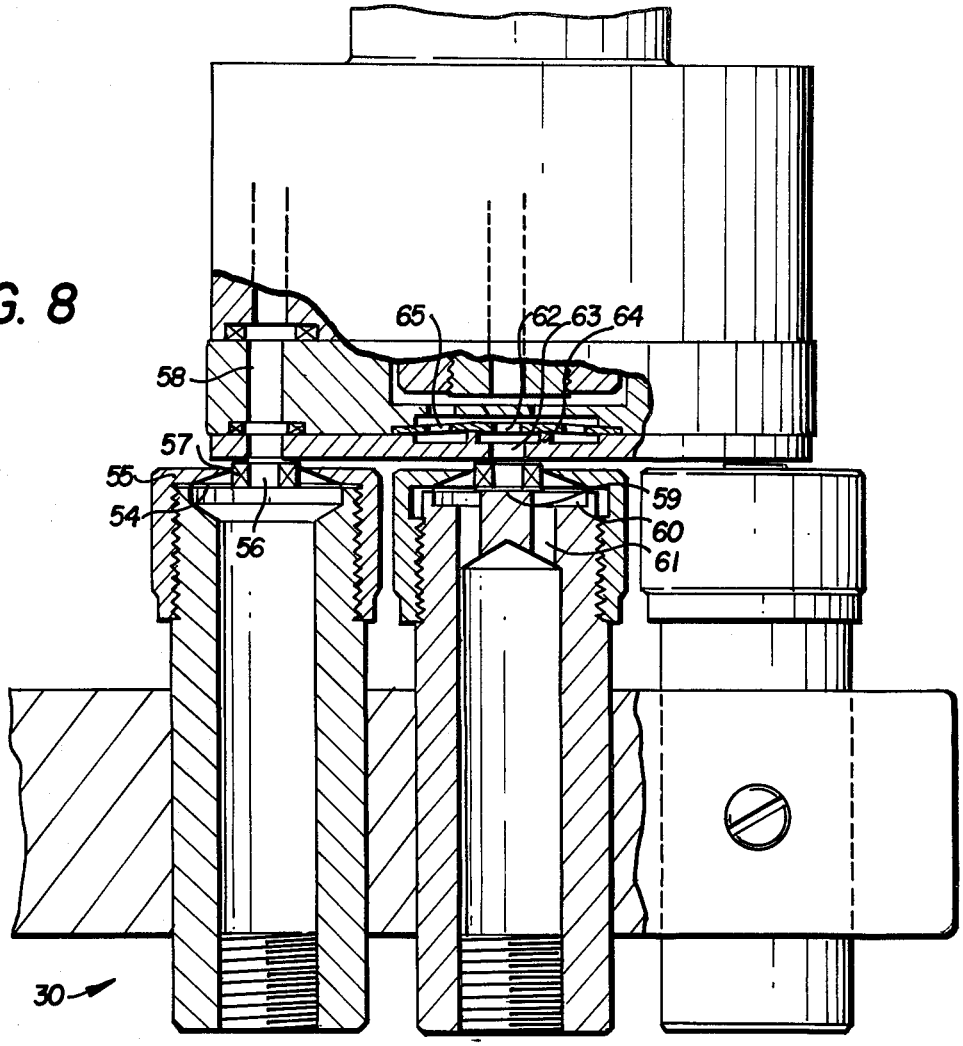
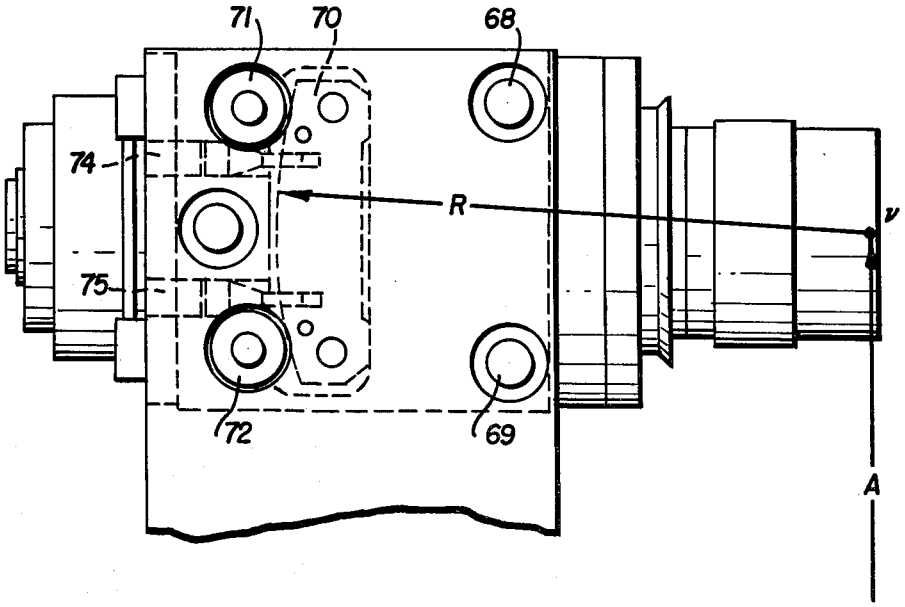
FIG. 10

HOLE GRINDING MACHINE

DESCRIPTION

1. Technical Field

The present invention relates to grinding machines of the type having at least one hole grinding function and at least one seat or dead end hole grinding function which enable the machine to grind concentric internal and end surfaces of dead end holes in workpieces.

2. Background Art

Grinding machines of this type commonly are used for internal grinding of injection nozzles for diesel engines, but can also be used for other, similar operations. Typically, the working operations to be carried out in such machines must be completed so that the workpiece will satisfy very exacting requirements for dimensional precision and concentricity of its finished surfaces. Such stringent requirements for dimensional accuracy and the always present desires for the highest possible production rate have made it desirable to complete the various grinding operations on each workpiece with the workpiece set up in a single well-centered chuck. Usually, however, the grinding of the inner surfaces and the end surfaces of a single dead end hole will require different grinding wheels. Thus, a general requirement for grinding machines of this type is that the grinding wheel spindles must be able to change positions in front of the workpiece set up in the chuck. This requirement usually has been fulfilled by using grinding spindles and chucks which are laterally displaceable in relation to each other. In machines with one chuck, the machining must then take place with one operation at a time. A certain relative displaceability of the grinding spindles in relation to the workpiece is required in each case for regulating the feed and cutting depth of the spindles. It has long been a practice to accomplish this displaceability by mounting the spindles on displaceable machine tables or slides arranged along guides ground with high precision in the machine frame.

According to another previously known variant which is described in the U.S. Pat. No. 3,430,388, three different chucks have been mounted in a rotatable chuck drum which is arranged to be indexed or stepwise rotated ⅓ turn for each indexing. This, together with three grinding spindles thereto adapted gives a multifunctional grinding machine in which three different grinding functions can be carried out simultaneously. After three indexings and intermediately completed grinding operations, a workpiece has thus been subjected to all three operations, in this case an internal hole grinding, a dead end hole grinding, and an end surface grinding. Theoretically, this is an acceptable solution to the problem of quickly completing multiple grinding operations on a workpiece following set up in a single chuck. However, it is very difficult if not impossible to manufacture such a machine with the precision required to ensure that the dimensional accuracy of workpieces machined in it will be within the fractions of thousandths of millimeters required, for example, in injection nozzles for high-class diesel engines. This is because an indexing head which is rotatable stepwise in one direction requires movable blocking and locking means which can be moved entirely out of the way as the head is indexed. Such movable means introduce problems with precision during manufacture of the machine and also are likely to develop play during use of the machine, both of which lead to further deterioration of the dimensional accuracy of the workpiece.

DISCLOSURE OF THE INVENTION

The present invention comprises an internal or hole grinding machine with at least two different grinding functions. At least one hole grinding function and at least one seat or dead end hole grinding function are included for grinding concentric internal and end surfaces of a dead end hole, or a through hole with an internal shoulder. The invention comprises a machine frame and an indexing head having a shaft supported in the frame for rotation between fixed indexing positions. At least two rotatably supported mechanically driven chuck spindles are mounted on the indexing head with their shafts parallel to the shaft of the indexing head. Each spindle at its end supports a chuck, preferably of the membrane type, for holding the workpieces which are to be machined. In the machine frame, opposite each respective chuck, a corresponding displaceable grinding spindle also is arranged. The different grinding spindles are provided with the type of grinding wheel to be used in each individual case. Measuring members for known types of measuring means also may be provided for control of the grinding process. The grinding spindles are supported in a known way on the machine table or on slides arranged so that the grinding spindles can be displaced along precision-ground guides provided in the machine frame. Displacement of the slides along such guides takes place by means of ball screws turned by D.C. servomotors.

According to the invention, the indexing head supporting the chuck spindles is arranged to be indexed or rotated reciprocally around its shaft between two indexing positions. Each position is accurately defined by a respective fixed stop connected with the machine frame against which a single locking cleat fixed to the indexing head is alternatingly moved into contact.

In a preferred embodiment, the chuck spindles are arranged in pairs on either side of and at the same distance from the shaft of the indexing head. By then rotating the indexing head one-half turn reciprocally at each indexing, the chuck spindles can be made to change places. At each of the fixed stops, braking or damping means are provided to slow the movement of the indexing head before it hits the stop. There is also a locking means to press the locking cleat of the indexing head against the fixed stop when the indexing head has reached the indexing position in question. The mechanism which rotates the indexing head is then entirely relieved so that no torsional stresses will arise in the machine. The advantages of this arrangement are several. The fixed stops on the machine frame and the locking cleat can be ground to a very high precision, and if they are provided with hard facings such as tungsten carbide, there will be practically no wear. Play in the locking means can be disregarded, since it is needed only to press together two locking surfaces which themselves determine the locking position. Preferably, the shaft of the indexing head is made rigid, with a comparatively large dimension, and is provided with bearings which are as free from play as possible so that the system on the whole will be very well defined and will operate with a very high degree of precision.

In order to direct the different functions of a grinding machine of the type disclosed, a numerical control system is preferably used, which may be supplemented with function-controlled sub-systems. For example, the invention comprises a pneumatic piston which rotates the indexing head, but at the same time a cam-controlled air valve has been used which relieves the piston and also to a certain extent brakes it before the indexing head reaches either end position.

For hoseless transmission of compressed air and cooling liquid to the indexing head, unique pressure-controlled valves are used, which are mounted at places on the machine frame where only a narrow slot separates the frame from the indexing head when the indexing head is in one of its end positions. These valves, which are arranged in the outlets of the conduits for the mediums in question, typically compressed air and cooling liquid, each comprise a preferably circular, comparatively thin elastic membrane fastened to the frame along its periphery. The membrane has a central outlet opening surrounded by a protruding sealing collar fastened thereto. When the pressure in the medium behind the membrane is increased above the ambient pressure, the sealing collar is forced forwards with the membrane in the flow direction of the medium until the sealing collar bridges the slot between the machine frame and the indexing head and makes sealing contact with the latter around an inlet opening provided in the indexing head. The leakage from valves of this type has proved to be surprisingly little, although a few drops of liquid will run out of the liquid valves before they have had time to close. In order to prevent leakage when the supply is cut off, the valves can be provided with non-return valve functions. Such check valves in the machine frame may comprise a fixed sealing surface which has the same form as the outlet opening of the membrane but is somewhat larger. The membrane contacts this sealing surface when the membrane is in its resting position with approximately the same pressure on both sides. The sealing surface then covers the entire outlet opening, but if the pressure on the inlet side of the membrane is increased, the elasticity of the membrane will allow the medium in question to flow past the sealing surface.

Check valves for the inlet in the indexing head are made according to similar principles, and comprise an elastic membrane which covers the inlet opening and on the intake side seals against a rigid annular seat which surrounds the inlet opening. The membrane is fastened along its outer periphery, and between the periphery and the seat there are flow openings which are uncovered when the pressure on the intake side is increased.

In an indexing grinding machine of the present type, the shafts of the chuck spindles must be set in parallel with the shaft of the indexing head. To accomplish this, the chuck spindle housings are fastened to precision-ground flat surfaces on the indexing head, whereby the shaft of the chuck spindle will automatically obtain a correct direction in one plane. Thereafter, the distance between the center of the chuck and the shaft of the indexing head is measured and the shaft of the spindle is set parallel to the shaft of the indexing head in a plane at right angles to the first plane. This last-mentioned operation requires that the chuck spindle housing is rotated around a point on a level with the position of the workpiece in the chuck, as the distance between the shafts will otherwise be changed at the same time as the shafts are set parallel.

In accordance with the present invention, this problem is solved by providing one of the components which is to be adjusted in relation to the other with a fixed circular arc cam which has its convex part facing away from the end of the chuck, and the radius of which corresponds to its distance to the center of rotation desired. The other component is forced, by a spring package, into contact with this cam with two circular studs or contact pins, which can be displaced laterally along the cam by means of one or a plurality of tapered setting screws supported in the first component. At such a lateral displacement along the curve, the chuck spindle will be turned around the center of rotation desired on a level with a workpiece set up in the chuck.

BRIEF DESCRIPTION OF THE DRAWINGS

The invention is defined in the appended claims. A preferred embodiment of the invention is shown in the accompanying drawings, in which:

FIG. 8 shows an enlarged, partially sectional view of the special valves for transmitting cooling and operating mediums between the machine frame and the indexing head;

FIG. 10 shows a top view, partially in phantom, of the means of FIG. 9.

BEST MODE FOR CARRYING OUT THE INVENTION

Figure 1:
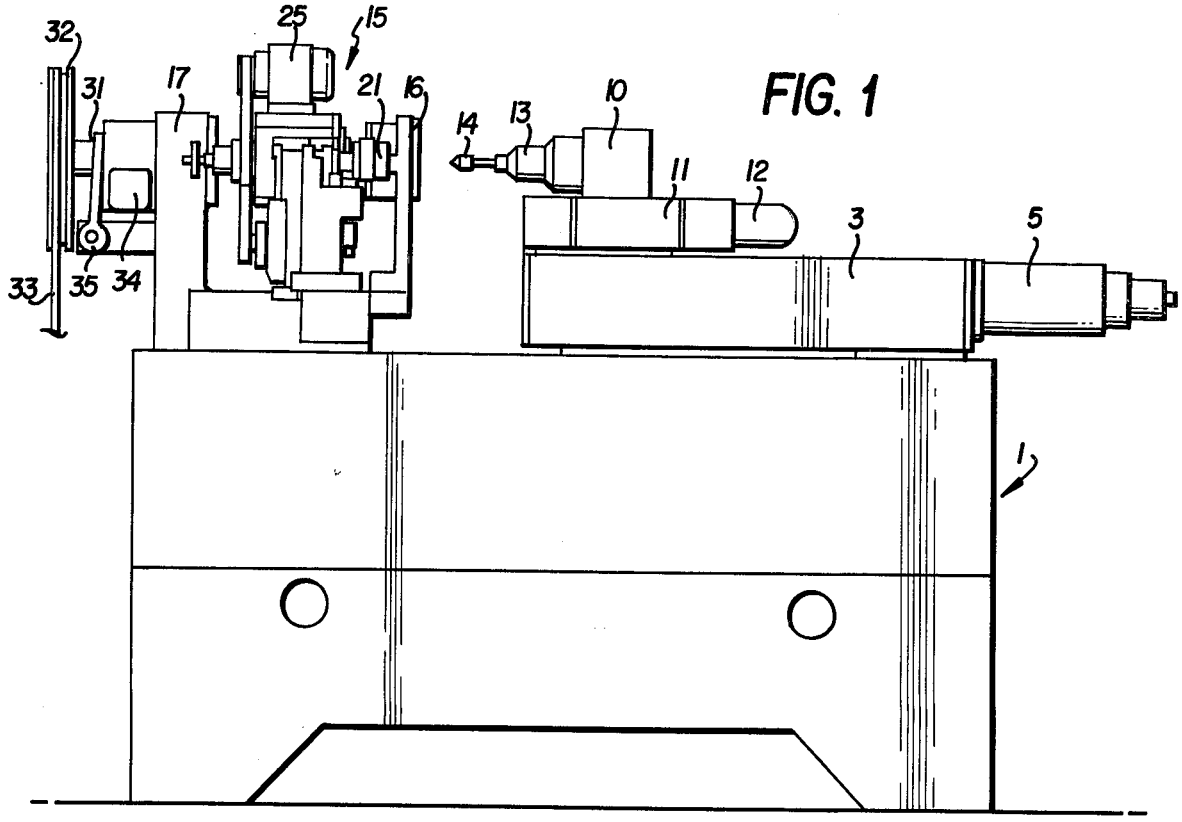
FIG. 1 shows a side elevation view of a grinding machine according to the invention.
Figure 2:
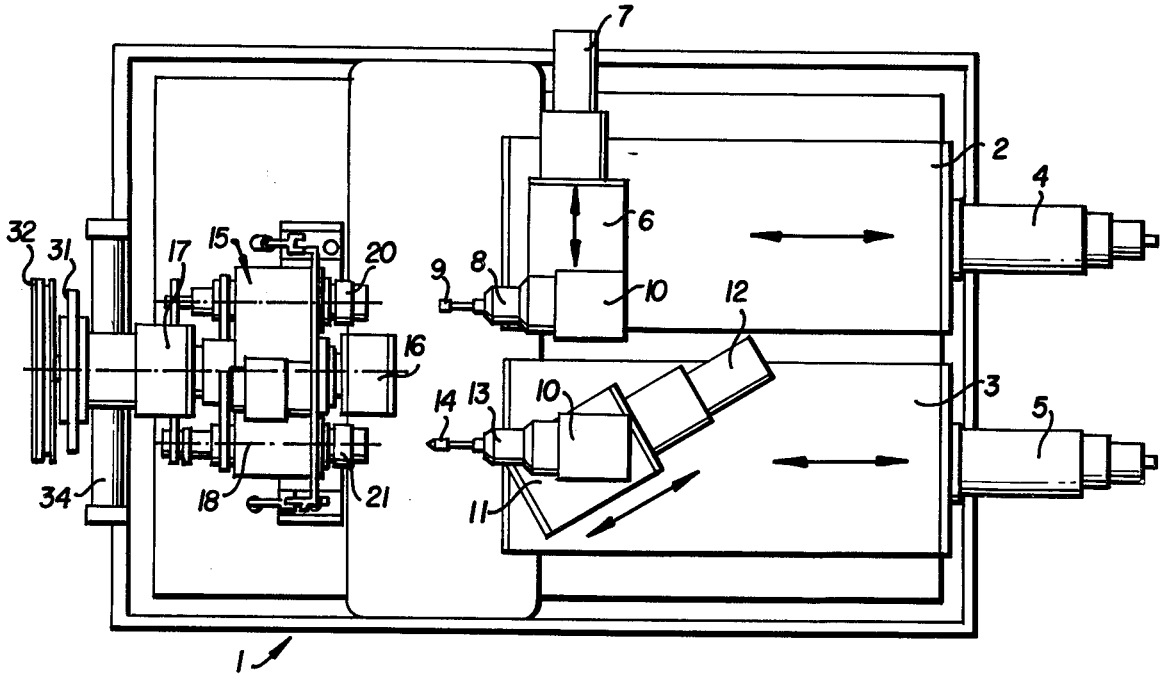
FIG. 2 shows a top view of the invention.
Figure 3:
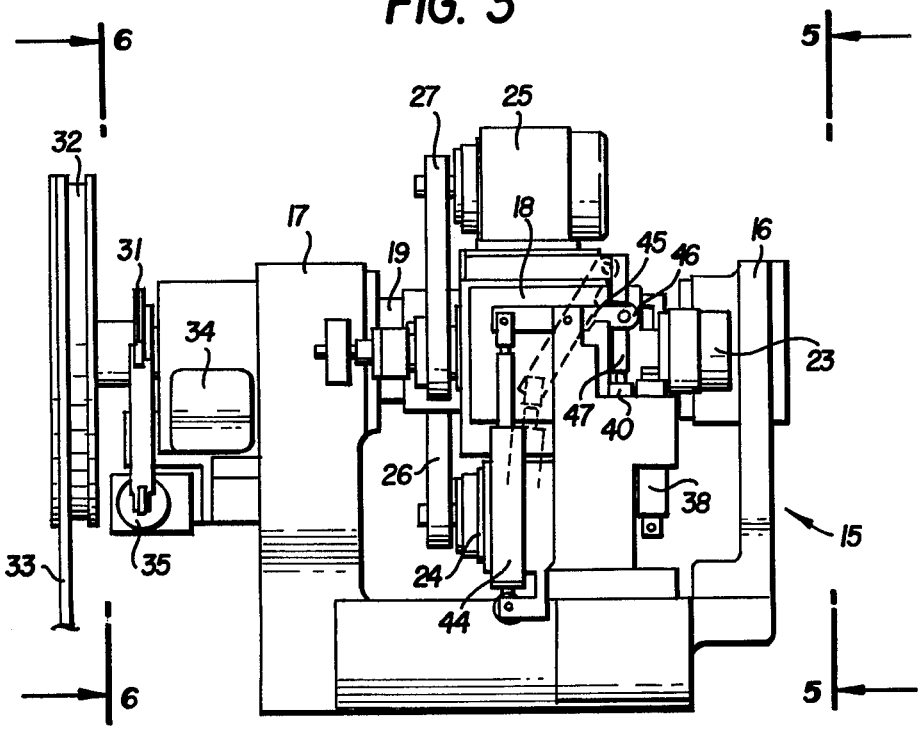
FIG. 3 shows an enlarged side elevation view of the indexing head embodied in the invention.

The grinding machine shown in FIGS. 1 and 2 comprises a machine table 1 on which two displaceable table slides 2 and 3 are arranged to move longitudinally along the table 1 on precision-ground guides by means of ball screws (not shown). The ball screws are driven by two D.C. servomotors 4 and 5, one at each table slide. On top of the table slide 2 and laterally displaceable in relation to it is a feed slide 6, also controlled by a ball screw (not shown) which is rotated by a D.C. servomotor 7. A grinding spindle 8 provided with a grinding wheel 9 is mounted on slide 6 and is driven by a high-frequency electric motor 10. An air-driven turbine also may be used in place of motor 10. In the illustrated embodiment, the grinding wheel 9 is arranged for internal grinding, and the table slide 2 then gives the grinding wheel its axial movement, while the feed slide 6 gives it its radial feed.

All of the feeding movements and other functions which are not discussed in detail in the following preferably are controlled by a central microcomputer system which will not be discussed in detail in this connection. One of the advantages of having all of the different functions of the device under a numerical control system is that this can be programmed to compensate for minor mechanical deviations between the movements of the various components and their directions in relation to given reference lines. For instance, it is possible to program the control system and thereby also compensate for different distances between the shafts of the chuck spindles and the shaft of the grinding head, by making the feeding movements of the grinding spindles dependent on the indexing position.

On the table slide 3 there is an oscillation slide 11, which is movable across the table slide 3 by a servomotor 12. The grinding spindle 13 and its grinding wheel 14 are mounted on the slide 11. The grinding spindle motor 10 is of the same type as the one for the grinding spindle 8. In the illustrated embodiment, the grinding wheel 14 is arranged for dead end hole grinding. For both grinding wheels there preferably are provided diamond trueing devices and measuring devices of types which are known in theselves and thus have not been included in the Figures. The measuring devices are connected to the microcomputer so that complete control of the grinding process is obtained.

As shown in FIGS. 3 to 6, exactly opposite the grinding spindles 8 and 13 is mounted the indexing head 18 according to the invention. The machine frame 1 continues upwards with supports 16 and 17 for the rotating shaft 19 of the indexing head 18. Rotatably mounted in the indexing head are two chuck spindles 20, 21, supported with their shafts parallel to and at the same distance from the axis of rotation of shaft 19. At their front ends facing the grinding spindles 8 and 13, chuck spindles 20, 21 are provided with well-centered chucks 22, 23 for setting up the workpieces which are to be machined. Each chuck spindle is driven by its own motor 24, 25, such as electric motors, which drives its respective spindle via belts 26, 27. Motors 24, 25 are mounted on opposite sides of shaft 19 for balance.

At the chuck spindle 20, a means 28 for setting the direction of the shaft of the chuck spindle is indicated in phantom. This feature will be described in more detail with reference to FIGS. 9 and 10. An identical means is provided for chuck spindle 21, but on the other side of indexing head 18, not visible in the Figures. At the rear ends of the chuck spindles, the hoseless transmission means for compressed air and cooling liquid are indicated at the connection points 29 and 30. These means will be described in more detail with reference to FIG. 8.

The shaft 19 of the indexing head 18 continues past the supporting point 17 and there carries a cam disc 31 and a cable reel 32. For the sake of clearness, the cable reel is not shown in FIG. 6. The advantage of the cable reel 32 is that even though the indexing head moves reciprocally between two positions, complex electric transmission devices for operating power for the motors 24 and 25 can be eliminated entirely. Moving electrical contacts such as slip rings and the like will sooner or later cause trouble. In the present invention, the electric cable 33 alternatingly is wound on and off the cable reel 32, in accordance with the reciprocating movements of the indexing head, and the portion of the cable extending from reel 32 to the motors, such as through shaft 19, maintains continuous fixed contact with the motors.

Figure 7:
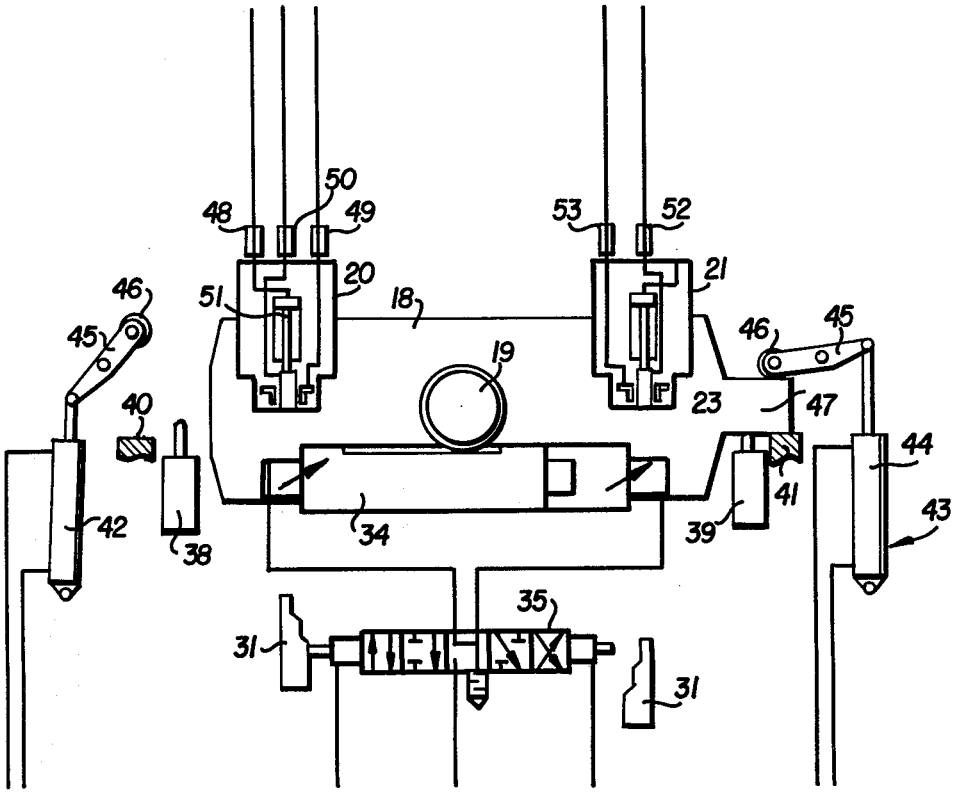
FIG. 7 shows in a simplified diagrammatic form the indexing and locking features of the indexing head.

For indexing or rotating the indexing head 18, there is a pneumatic rotating cylinder 34 fixed to frame 1. Regulating air for cylinder 34 is provided via the sliding valve 35. As shown in FIG. 7, the piston of the rotating cylinder 34 is connected directly via a gear rack-gear arc transmission to the shaft 19 of the indexing head 18. To cause indexing, the previously mentioned microcomputer or other controller directs regulating air to the sliding valve 35 via a valve not shown. The sliding valve 35 is then displaced to its opposite end position, and as shown by the simplified illustration in FIG. 7, this end position is determined by the cam 31, which in FIG. 7 has been drawn simplified in the form of two partial cam profiles. The sliding valve now conducts a flow of air to one side of the piston 34, and drains the other side. As the indexing head is turned, the cam 31 follows its movement. The cam will then via one of the knee transmissions 36 and 37 shown in FIG. 6 actuate the sliding valve 35 so that immediately before the indexing head reaches its end position, the piston 34 will be relieved on both sides. Between these two end positions there is an intermediate position where the intake is cut off but the outlet side is drained. At each end position of indexing head 18 there is also a damping cylinder 38, 39 to stop the movement of the indexing head. Each end position is defined by stops 40, 41 fixed to the machine frame 1. There is also arranged a locking means 42, 43, air-controlled to be activated by the microcomputer system. Each locking means comprises a pneumatic cylinder 44 and a rocker 45 connected with the cylinder and provided with a roller 46. When the locking means is activated, roller 46 is moved into contact with a locking cleat 47 on the indexing head, so that movement of rocker 45 forces cleat 47 into close contact with the stop 40 or 41 in question. The stops 40 and 41 and the two sides of the locking cleat 47 should appropriately be provided with very hard and durable surfaces such as tungsten carbide facings, as it is these surfaces which define the two settings of the indexing head.

Continuing with FIG. 7, chuck spindles 20 and 21 are shown symbolically, but without driving motors. Via the special valves 48, 49 and 50, each chuck spindle has two connections for compressed air and one for cooling liquid. The compressed air is used to open the chuck 22 and to operate an ejector 51. In the grinding machine illustrated here, loading and unloading of the chucks takes place at the same indexing position as the seat grinding, as this takes considerably shorter time than the grinding of the side of the hole. The loading and unloading take place by means of an automatic device of a previously known type which has therefore not been included in the Figures. It is not included in the grinding machine itself, but is a complement to it. At the chuck spindle 21 there is a hoseless transmission means for cooling liquid via the valve 52 and compressed air via the valve 53.

The design of the valves is shown in more detail in FIG. 8. The valves all comprise the same basic component, that is the membrane 54. When the valve is intended for transmission of liquid, it also is provided with a check valve feature; if it is intended for compressed air, the check valve is not needed. The valve for transmission of compressed air comprises a substantially circular elastic membrane 54 fastened by means of a nut 55 along its periphery at the outlet mouth. The membrane is provided with a central opening 56, surrounded by a sealing collar 57. When the pressure is increased behind the membrane by compressed air being regulated by the control system for actuation, for example, of the ejector or the membrane chuck, the sealing collar 57 with the elastic membrane is forced into contact with the indexing head on the other side of the slot which separates the head from the valves arranged in the machine frame. The sealing collar 57 will then come into contact around an intake opening 58 arranged in the indexing head. In this case, it is arranged in a non-rotating sleeve which surrounds one of the rear ends of the chuck spindles.

For transmission of liquid, the valve 50 is provided with a non-return feature comprising a sealing surface 59 located upstream of collar 57 and central opening 56. Membrane 54, when not subjected to an over-pressure, rests on surface 59 so that the surface blocks central opening 56. When the pressure behind the membrane is increased, it is forced away from surface 59 so that liquid leaks past the sealing surface. Thus, the area of surface 59 is somewhat larger than the opening 56. In the illustrated embodiment, the sealing surface is surrounded by an annular slot 60 having openings 61 leading to the intake channel. At the inlet opening in the indexing head, a check valve is arranged, which comprises a peripherally mounted membrane 62 which closes the inlet opening 63 by seating against an annular seat 64 which surrounds the inlet opening. The membrane 62 is provided between its periphery and annular seat 64 with a number of flow openings 65. The functioning principle is the same as for the non-return valve function on the other side of the slot. When the pressure is increased on the intake side of the membrane, it moves away from seat 64 and the flow openings 65 are uncovered. If the pressure decreases owing to the supply of cooling liquid having been cut off farther back in the system, the two non-return valves will close immediately.

Figure 4:
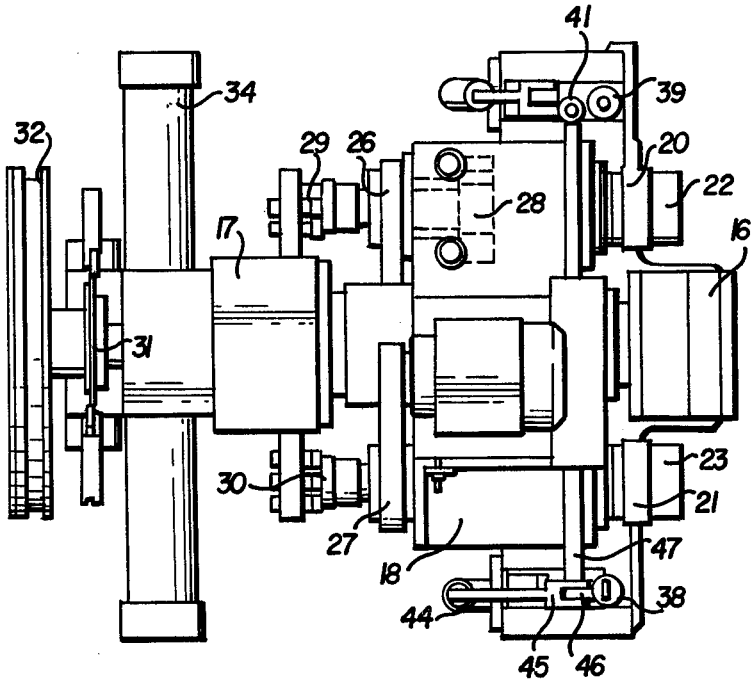
FIG. 4 shows a top view of the indexing head according to FIG. 3.
Figure 5:
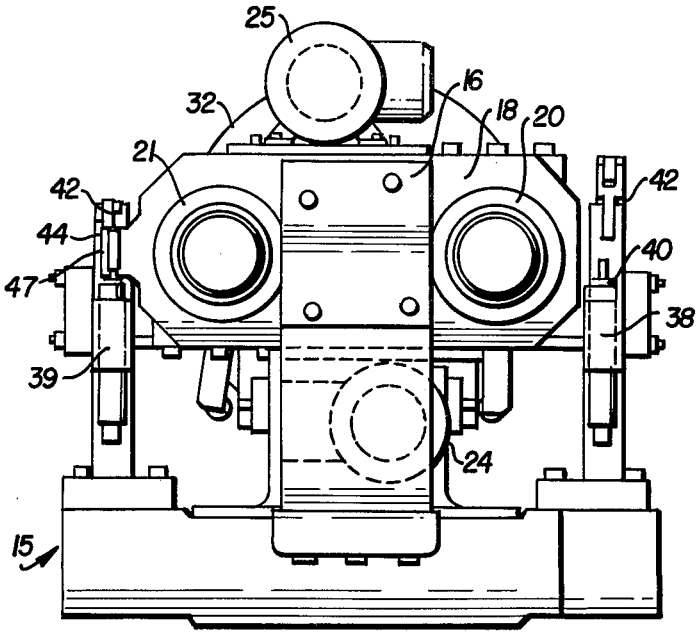
FIG. 5 shows a view taken along line 5—5 of FIG. 3.
Figure 6:
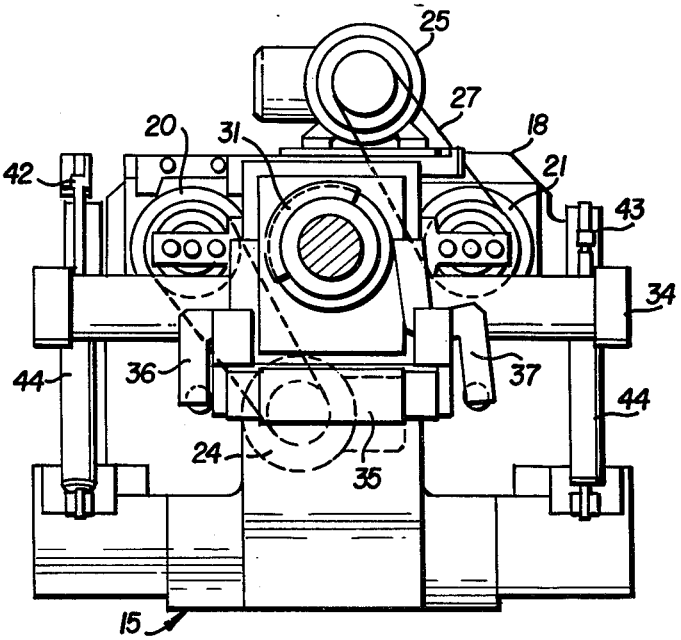
FIG. 6 shows a view taken along line 6—6 of FIG. 3.
Figure 9:
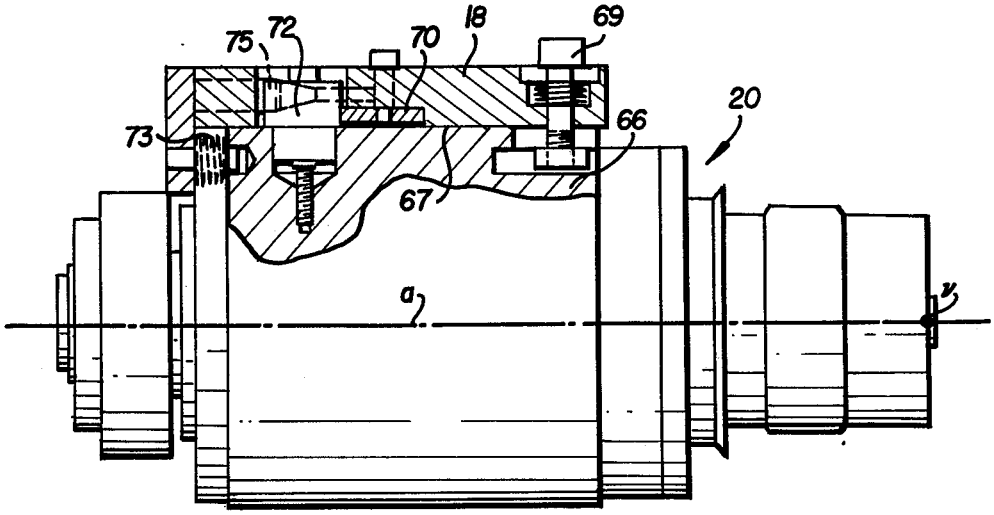
FIG. 9 shows an enlarged, partially sectional side view of the means for setting the shaft of the chuck spindle parallel to the shaft of the indexing head.

FIGS. 9 and 10 illustrate a means for fine adjustment of the shafts of the chuck spindles around a given center of rotation. This means also is indicated in FIG. 4 as element 28. Chuck spindle 20 has its housing 66 mounted on an accurately planed and measured surface 67 on the indexing head 18. For fastening the chuck spindle housing 66 there are two screws 68 and 69, The surface 67 locates the shaft of the chuck spindle in the correct position in one plane, in this case the horizontal plane "a" in FIG. 9. If the distance of the center V of the front face of the chuck spindle is then corrected to the desired distance A from the shaft of the indexing head, all that remains is to set the shaft of the chuck spindle parallel to the shaft of the indexing head. In order that the distance A should not be changed then, a rotation, if any, of the chuck spindle must be made around the center of rotation V.

In order to achieve this result, a cam surface is provided in the indexing head. This cam has its convex side facing away from the center of rotation V and the radius of the curve is equal to the distance R to the point V. In the chuck spindle housing 66 there are arranged two circular contact pins 71 and 72 which are in contact with the cam mounted in the indexing head. In order to ensure good contact between the contact pins and the cam, there is one or a plurality of spring packages 73. Further, there are two setting screws 74, 75, supported in the indexing head, which with their conical points are in contact with the contact pins. By turning the setting screws, the chuck spindle housing 66 can be displaced along the cam 70 as long as the screws 68 and 69 have not been tightened completely. Thus, the chuck spindle housing is turned around the point of rotation V, which makes it possible to adjust the chuck spindle in relation to the shaft of the indexing head, without any change of the distance from the chuck to the indexing head taking place.

Having described our invention in sufficient detail to enable those skilled in the art to make and use it, we claim:

1. An improved indexing head apparatus for use in grinding machines of the type including a frame, a first grinding means mounted on said frame for internal grinding of an axially extending hole in a workpiece and a second grinding means mounted on said frame for grinding internal seats or deadend holes, said apparatus comprising:

a shaft;

means adapted to be mounted on the frame for supporting said shaft for rotation;

a head element mounted on said shaft for rotation therewith;

a pair of chuck spindles mounted for rotation on said head element, said spindles each having a chuck for holding a workpiece in position to be ground by said grinding means;

means for reciprocating said head element and said shaft between two end positions located one half turn from each other whereby each chuck spindle with its associated chuck and workpiece is alternatingly positioned for grinding the workpiece first by the one and then by the other of said grinding means;

a pair of stop means fixed relative to said frame for defining said end positions;

means mounted on said head element for contacting one of said stop means at each of said end positions;

means for disengaging said reciprocating means prior to contact of said head element with said stop means; and means cooperating with said contacting means for completing movement of said contacting means into contact with said stop means and holding said head element in such position while grinding is in process.

2. Apparatus according to claim 1, wherein said chuck spindles are arranged in pairs on either side of and at the same distance from said shaft.

3. Apparatus according to claim 1, wherein at each of said stop means there is provided means for braking movement of said head element before said contacting means reaches the associated one of said stop means.

4. Apparatus according the claim 1, wherein said reciprocating means comprises a fluid driven piston connected with said head element for rotating it with said shaft, a control valve for directing movement of fluid to and from said piston, a cam element mounted on said shaft and cam follower means mounted on said frame for actuating said control valve in response to movement of said cam element; and said disengaging means comprises a portion of said control valve which releases fluid pressure acting on said piston prior to contact of said head element with said stop means.

5. Apparatus according to claim 1, wherein said frame and said head element are separated by a narrow slot when said head element is in either of said end positions, said chucks are fluid operated and said chuck spindles are fluid cooled, further comprising a plurality of fluid pressure controlled valve means in said frame and said head element for regulating fluid flow to said spindles and chucks across said slot from conduits in said frame.

6. Apparatus according to claim 5, wherein each of said valve means comprises an elastic membrane fastened along its periphery to said frame, said membrane having a central opening communicating with one of said conduits in said frame and a sealing collar surrounding said opening and protruding into said slot, whereby fluid pressure acting on said membrane causes said sealing collar to move across said slot and to seal around a fluid inlet opening provided in said head element.

7. Apparatus according to claim 6, wherein at least a portion of said valve means comprise a fixed sealing surface on the intake side of said membrane, against which surface said membrane seats around said central opening when substantially no pressure drop exists across said membrane, thereby preventing fluid leakage.

8. Apparatus according to claim 7, wherein at least a portion of the fluid inlet openings provided in said head element are provided with check valves comprising a further elastic membrane fastened along its periphery to said head element, said fluid inlet opening being surrounded on its discharge side by an annular seating surface against which said further membrane seats when substantially no pressure drop exists across said further membrane, said further membrane being provided with through openings between its periphery and said annular seating surfaces, said through openings communicating with further conduits in said head element.

9. Apparatus according to claim 1, further comprising means for adjusting the positions of said chuck spindles so that their axes are parallel to the axis of said shaft.

10. Apparatus according to claim 9, wherein said adjusting means comprises a chuck spindle housing adjustably mounted to said head element for each spindle; cam means mounted in one of said chuck spindle housing or said head element, said cam means having a convex surface with a radius of curvature corresponding to the distance from said cam surface to the front edge of the respective chuck; a pair of contact pins mounted in the other of said chuck spindle housing on said head element in position to contact said cam surface; means for pressing said pins against said cam surface; at least one tapered setting screw, mounted in the same one of said chuck spindle housing or said head element as said cam means, for displacing said pins along said cam surface; and means for fixing the position of said chuck spindle housing relative to said head element.

* * * * *